US005503291A

United States Patent [19]

Craig

[11] Patent Number: 5,503,291

[45] Date of Patent: Apr. 2, 1996

[54] TANKSHIP CARGO BLADDER

[76] Inventor: James E. Craig, PACO133 - Box 37301, Washington, D.C. 20013

[21] Appl. No.: 96,441

[22] Filed: Jul. 26, 1993

Related U.S. Application Data

[63] Continuation of Ser. No. 845,001, Mar. 3, 1992, abandoned, which is a continuation of Ser. No. 363,606, Nov. 8, 1989, abandoned.

[51] Int. Cl.[6] ..... B65D 88/00

[52] U.S. Cl. ..... 220/403; 220/901; 114/73; 114/74 R

[58] Field of Search ..... 220/403, 901; 114/73, 74 R

[56] References Cited

U.S. PATENT DOCUMENTS

| | | | |
|---|---|---|---|
| 1,111,740 | 9/1914 | Frear | 114/74 R |
| 1,155,028 | 9/1915 | Young | 114/73 |
| 3,272,373 | 9/1966 | Alleaume et al. | 220/901 X |
| 3,440,990 | 4/1969 | Van Riet et al. | 114/73 X |
| 3,699,912 | 10/1972 | Wilson, Jr. | 114/74 R |
| 4,101,045 | 7/1978 | Roberts et al. | 220/901 X |
| 4,982,678 | 1/1991 | Frederick | 220/403 X |
| 5,031,558 | 7/1991 | Davis | 114/74 R |
| 5,038,960 | 8/1991 | Seery | 220/403 |
| 5,107,782 | 4/1992 | Frederick | 220/403 X |
| 5,203,272 | 4/1993 | Kassinger et al. | 114/74 R |
| 5,225,812 | 7/1993 | Faghri | 114/74 R X |

*Primary Examiner*—Steven M. Pollard
*Attorney, Agent, or Firm*—James J. Brown

[57] ABSTRACT

A bladder is disclosed for providing a liquid impervious liner for the cargo compartments of vessels used to transport liquids such as petroleum and petroleum products. The bladder prevents spillage of the liquid cargo in the event the hull is breached and facilitates cleaning of the cargo compartments without environmental impairment.

1 Claim, 3 Drawing Sheets

TANKSHIP CARGO BLADDER

CROSS-REFERENCE TO RELATED APPLICATIONS

This application is a continuation of application Ser. No. 07/845,001, filed Mar. 3, 1992, now abandoned, which was a continuation of application Ser. No.: 07/363,606, filed Nov. 8, 1989, also now abandoned.

SUMMARY OF THE INVENTION

The present invention is directed to a liquid impervious, flexible bladder which is employed within the cargo compartments of a vessel such as an oil tanker or other vessel used for transporting large quantities of liquid material. While the main purpose of the internal bladder system of the invention is to diminish or eliminate the danger of spillage of the liquid contents of the vessel, the system also facilities cleaning of the cargo area once the cargo has been removed from the vessel.

BACKGROUND OF THE INVENTION

With the world increasingly relying on petroleum and petroleum products which must be shipped over long distances in ever larger tank ships, concern over the environmental impact of transporting these potentiality hazardous liquids has justifiably increased. Within recent years severe ecological damage has either occurred or narrowly been averted on a number of occasions where large vessels carrying crude oil, for example, have either been involved in collisions or groundings which resulted in rupturing the hulls of the vessels with subsequent leakage of the petroleum content into the surrounding environment.

Obviously, the world will continue for the foreseeable future to require large quantities of petroleum and petroleum products and it is to be anticipated that increasingly these products and raw petroleum will have to be shipped across the world's ocean. Equally clearly, economy dictates that much of this transport will take place in large tank type vessels carrying sufficient quantities of crude oil or petroleum products to cause extensive damage to the ecology if the integrity of the vessel is breached.

At present, large tankers such as those used to transport crude oil contain a number of segmented compartments for holding the crude oil cargo. These compartments in fact normally comprise the greater part of the vessel's hull and are not provided with protection against collision or penetration by objects. The result is that if the hull of these vessels is breached, a significant spillage of the contents is to be anticipated.

It is accordingly an object of the present invention to provide a system for protecting the cargo compartments of vessels which transport liquid material with a flexible safety liner which will contain the liquid product and prevent its spillage should the hull of the vessel be ruptured.

It is a further object of the present invention to provide a flexible bladder for the cargo compartments of vessels carrying liquids which will facilitate the cleaning of the cargo area once the liquid cargo has been discharged.

DETAILED DESCRIPTION OF THE DRAWINGS

DETAILED DESCRIPTION OF THE INVENTION

In accordance with the invention, a cargo tank vessel of the type generally employed for transporting oil or petroleum or other liquid chemical products in segmented compartments within the vessel is provided with one or more internal, flexible bladders which form liners within each cargo compartments to prevent leakage or spillage of the liquid cargo of the vessel. Thus, in accordance with the present invention each of the vessel's cargo compartments is provided with a bladder which prevents the contained liquid cargo from spilling even in the event that the hull of the vessel is ruptured.

The present invention further provides a releasable top cover to each compartment which responds to internal pressure on the bladder to permit the bladder to actually emerge partially or totally from the compartment depending upon the extent of the external pressure applied thereto.

The invention will however, be more fully appreciated by having specific reference to the drawings which depict a preferred embodiment of the present invention as presently contemplated.

Figure 1:
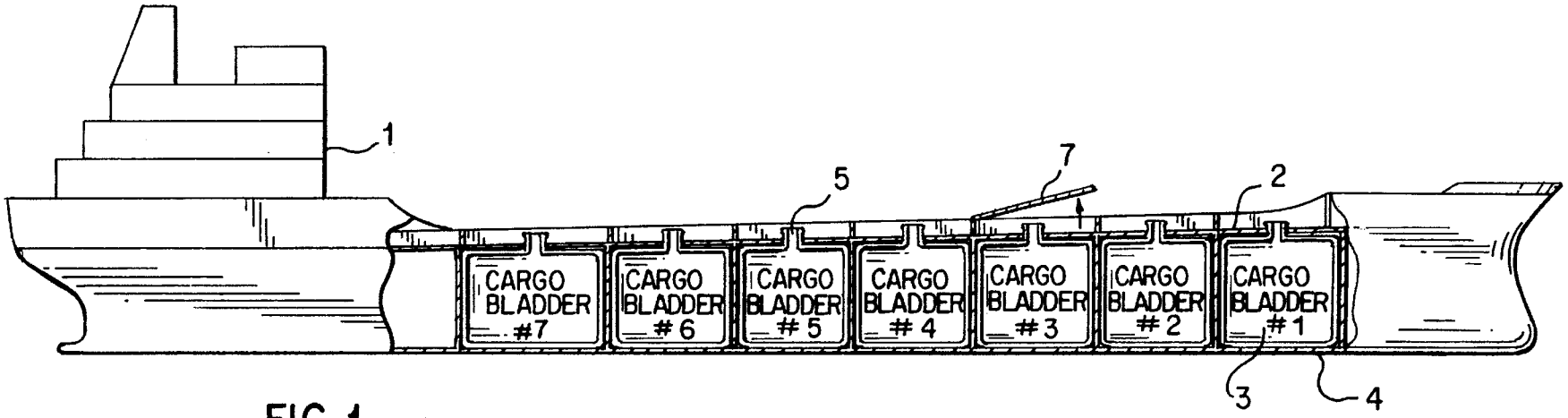
FIG. 1 is a side cut away view of a tankship showing the cargo compartments with internal bladders installed.
Figure 2:
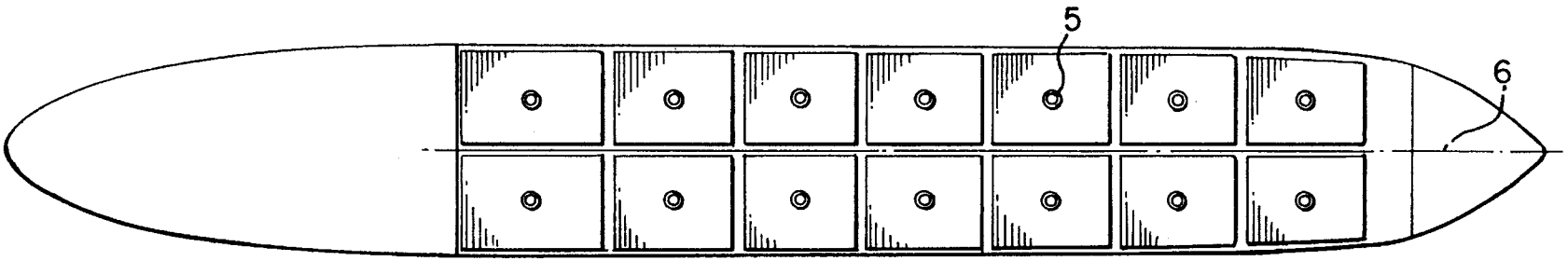
FIG. 2 is a top plan view illustrating the tankship of FIG. 1.
Figure 3:
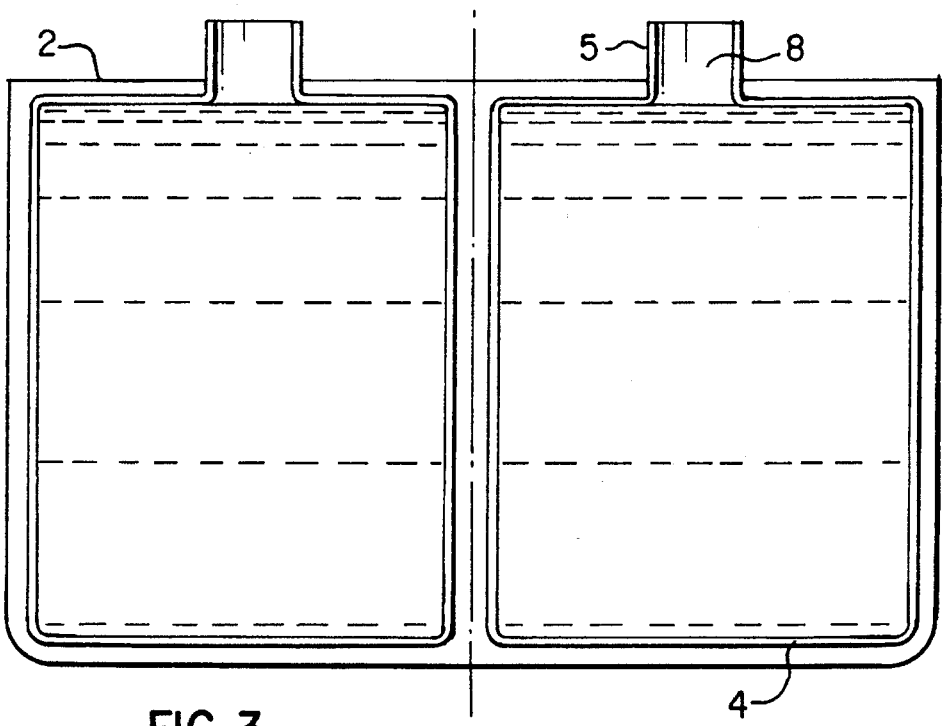
FIG. 3 is a mid ship section view illustrating in detail side by side cargo tank bladders and compartments of the tank ship of FIG. 1.

Directing attention to FIGS. 1 and 2 of the drawings, a typical cargo tank ship for transporting liquid cargo in a plurality of compartments is shown at 1. As seen in the drawing, the hull of the vessel is divided into seven discrete cargo compartments 3 each of which is provided with a liquid impervious flexible bladder 4 which when filled assumes the shape and dimensions generally of the compartment in which it is disposed. An air chamber 5 is provided at the top of each compartment to allow liquid to be shifted in case of damage or penetration. This also provides a convenient hatch for unloading the liquid contents. The main deck of the vessel 2 is arranged to provide a series of hinged or otherwise displaceable coverings 7 over each of the compartments such that should sufficient pressure be exerted against the filled bladder in each compartment, the bladder will actually be displaced against the top cover 7 to force it open and allow the bladder to emerge from the compartment rather than being compressed against the internal walls of the compartment.

Figure 4:
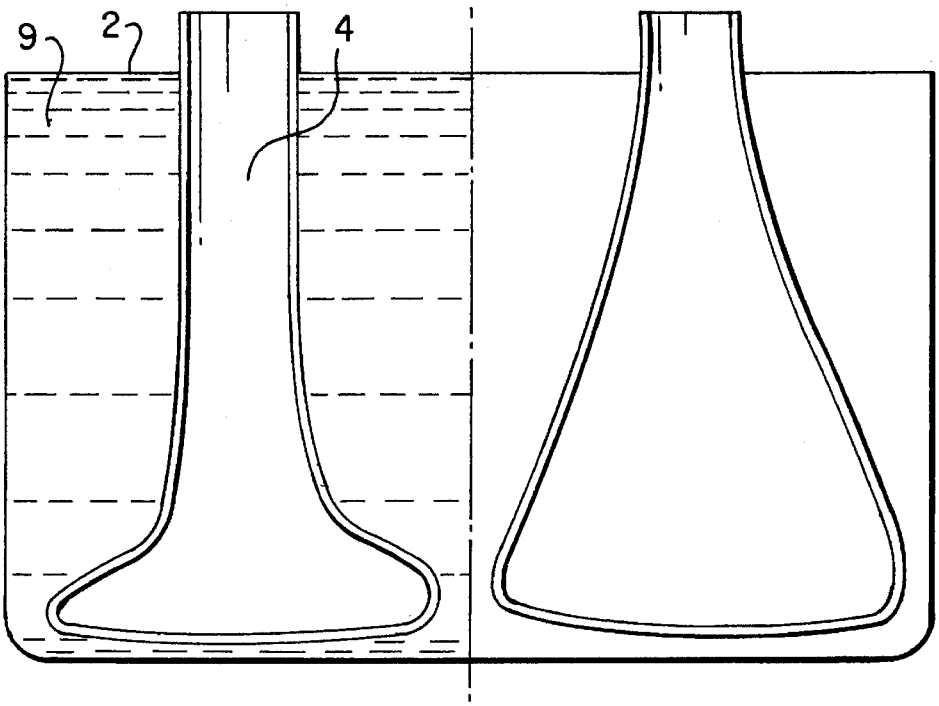
FIG. 4 is a section view of side by side cargo compartments illustrating the internal bladders when empty and when surrounded by water ballast.

FIG. 4 illustrates in cross section the bladder 4 in its empty configuration. As shown to the left of the center line of the vessel, salt water ballast 9 can be pumped to the compartment area external to the bladder to provide ballast for the vessel without the salt water becoming contaminating with cargo residue from the inside of the bladder.

Figure 5:
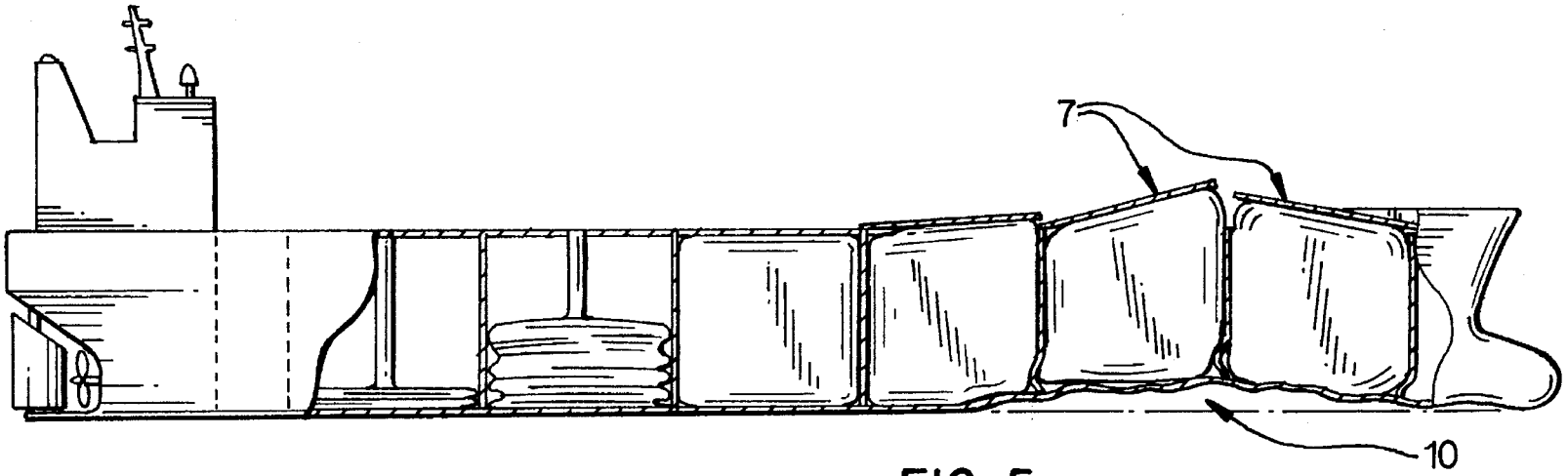
FIG. 5 is a cut away side view of the marine cargo tankship of FIG. 1 illustrating the bladder release mechanism for responding to pressure applied against one or more of the internal compartment bladders of the invention.
Figure 5A:
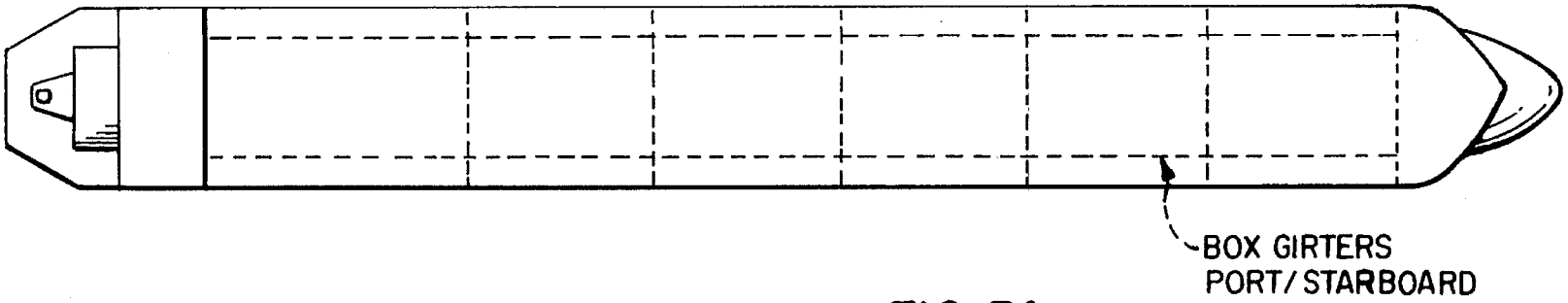
FIG. 5(A) is a top view of the tankship of FIG. 5.

FIG. 5 of the drawings illustrates the function of the tank top collision bladder release 7 which is provided on the main deck as covering for each of the compartments into which a bladder is fitted. As shown in the drawings grounding damage 10 has caused upward pressure to be exerted against the bottom of the first three cargo compartments at the bow of the vessel. This upward pressure has forced the bladders full of liquid upward so that the bladder release covers are displaced to allow emergence of the bladder from the compartment. This avoids having the bladders contained within there compartments where pressure applied at one point results in pressure against the side walls of the compartment with possible subsequent rupturing thereof. In cases of sufficiently severe damage to the sides or bottom of the vessel, the bladder containing the liquid cargo can actually be totally forced out of the damaged compartment without rupturing and while still maintaining the liquid contents safely within the flexible bladder.

While a preferred embodiment of the present invention has been described, it will be appreciated that other variations and embodiments of the invention are considered to fall within the scope of the invention as described in the claims appended hereto.

What is claimed is:

1. In a cargo tank vessel employing a water ballast and having one or more compartments for accommodating liquid cargo, the improvement comprising providing said compartments with one or more flexible liners which form liquid impervious bladders within said compartments, and prevent contact between said liquid cargo and said ballast, which is contained exterior of said bladder, each of said compartments being enclosed on its top side by a cover which is adapted to disengage from the compartment in response to internal pressure against said bladders resulting from external pressure against the vessel's hull, thereby causing all or a portion of said bladders to emerge from said compartment, said cover being contiguous with a portion of the deck of the vessel.

* * * * *